US012458119B2

(12) United States Patent
Lin

(10) Patent No.: US 12,458,119 B2
(45) Date of Patent: Nov. 4, 2025

(54) HAND-HELD MOTORIZED UMBRELLA

(71) Applicant: Calvin H Lin, San Gabriel, CA (US)

(72) Inventor: Calvin H Lin, San Gabriel, CA (US)

( * ) Notice: Subject to any disclaimer, the term of this patent is extended or adjusted under 35 U.S.C. 154(b) by 245 days.

(21) Appl. No.: 18/234,842

(22) Filed: Aug. 16, 2023

(65) Prior Publication Data

US 2025/0057292 A1 Feb. 20, 2025

(51) Int. Cl.
*A45B 25/02* (2006.01)
*A45B 25/06* (2006.01)
*A45B 25/16* (2006.01)

(52) U.S. Cl.
CPC ..... *A45B 25/165* (2013.01); *A45B 25/02* (2013.01); *A45B 25/06* (2013.01); *A45B 2200/1009* (2013.01)

(58) Field of Classification Search
CPC ..... A45B 25/165; A45B 25/02; A45B 2023/0075; A45B 2023/0031; A45B 2017/005
USPC ..... 135/19.5, 29
See application file for complete search history.

(56) References Cited

U.S. PATENT DOCUMENTS 1,042,174 A * 10/1912 Tyminski ..... A45B 19/10 135/25.31
1,541,278 A * 6/1925 Pugel ..... A45B 25/16 135/22
1,801,913 A * 4/1931 Frederick ..... E04H 15/28 135/98
2,654,380 A * 10/1953 Eichenbaum ..... A45B 25/18 135/33.2
4,131,954 A * 1/1979 Brock ..... A42B 1/201 135/96
4,240,454 A * 12/1980 Tsai ..... A45B 25/16 135/24
4,813,442 A * 3/1989 Haines ..... E04H 15/58 135/98
4,936,332 A * 6/1990 Wu ..... A45B 25/143 135/24
5,193,566 A * 3/1993 Chen ..... A45B 25/02 135/31

(Continued)

FOREIGN PATENT DOCUMENTS

CN 201515766 U 6/2010
EP 2774503 B1 4/2017
GB 2228674 A 5/1990

OTHER PUBLICATIONS

International Search Report and Written Opinion of International Searching Authority, Application PCT/US2024/035645, mailed Sep. 19, 2024.

*Primary Examiner* — Noah Chandler Hawk

(57) ABSTRACT

An umbrella may be provided including a hub, a plurality of arms, a plurality of stretchers, a plurality of ribs, a runner, and a motor. Each of the plurality of stretchers is coupled to the hub at one of a plurality of first joints. Each of the plurality of stretchers is coupled to one of the plurality of arms. Each of the plurality of ribs extends outwardly from one of the plurality of arms. Each of the plurality of the arms is more rigid than each of the plurality of ribs. The runner is moveable from a first position to a second position. Each of the stretchers is coupled to the runner at one of the plurality of second joints. The motor is coupled to the runner. The motor is adapted to move the runner from the first position to the second position.

20 Claims, 4 Drawing Sheets

(56) References Cited

U.S. PATENT DOCUMENTS

| | | | | |
|---|---|---|---|---|
| 5,291,908 | A * | 3/1994 | Grady | A45B 25/165 135/22 |
| 5,601,103 | A | 2/1997 | Dubinsky | |
| 6,095,169 | A | 8/2000 | Lin et al. | |
| 7,562,666 | B2 | 7/2009 | Chan | |
| 7,591,274 | B2 * | 9/2009 | Lin | A45B 25/02 135/31 |
| 8,567,422 | B2 * | 10/2013 | Lee | A45B 25/02 135/22 |
| 8,757,183 | B2 | 6/2014 | Volin | |
| 10,323,433 | B2 | 6/2019 | Gharabegian | |
| 10,819,916 | B2 | 10/2020 | Gharabegian | |
| 11,044,972 | B2 * | 6/2021 | Hermanson | A45B 19/04 |
| 2013/0148334 | A1 * | 6/2013 | Chen | A45B 3/04 362/102 |
| 2015/0245691 | A1 | 9/2015 | Fitzgerald et al. | |
| 2018/0042346 | A1 * | 2/2018 | Kong | H04B 1/08 |
| 2019/0069654 | A1 | 3/2019 | Chen | |
| 2019/0166963 | A1 | 6/2019 | Gharabegian | |
| 2021/0361042 | A1 | 11/2021 | Mullet et al. | |
| 2022/0007803 | A1 * | 1/2022 | Hermanson | A45B 25/14 |
| 2023/0157426 | A1 | 5/2023 | Sunbao | |

* cited by examiner

HAND-HELD MOTORIZED UMBRELLA

TECHNICAL FIELD

This disclosure relates to umbrellas and, in particular, to hand-held motorized umbrellas.

BACKGROUND

The statements in this section merely provide background information related to the present disclosure and may not constitute prior art.

Umbrellas are well known devices in many areas of the world. However, the vast majority of hand-held umbrellas operate manually, through user movement of a runner to open, close, or latch the canopy, or semi-automatically, by triggering a mechanical device such as a spring to open, close, or latch the canopy. In particular manual umbrellas can be inconvenient and even messy to close after rain has soaked the canopy. Therefore, a hand-held umbrella which may be motorized to fully automatically open and close automatically is desirable.

Additionally, because holding an umbrella requires the use of one hand, users of umbrellas are frequently hindered in the use of their other hand. For example, while using an umbrella, they cannot hold another object and answer an incoming call with their phone at the same time. Even if the phone is operated with headphones, the user must still take headphones from a pocket or case, place them on their ear, and then pair them to the phone before being operative. Such steps may require one or both hands, causing inconvenience for the user of the umbrella, especially in heavy rain. Therefore, an umbrella which can easily be paired to a phone, which can be used as a speaker and microphone for a phone, and which can be opened and closed with just one hand is desirable.

Moreover, hand-held umbrellas are frequently difficult to manufacture, requiring multiple tools and multiple processes. For example, even after all components have been gathered, assembly of the umbrella may require riveting components of the rib together, stitching the canopy to the folding mechanism of the umbrella, loading a spring mechanism, and screwing other components of the umbrella together. Multiple tools and multiple processes drives up the cost of umbrella assembly. Therefore, an umbrella which is easy to assemble with a single tool and a single process is desirable.

SUMMARY

Further areas of applicability will become apparent from the description provided herein. It should be understood that the description and specific examples are intended for purposes of illustration only and are not intended to limit the scope of the present disclosure.

In one embodiment, an umbrella is provided including a hub, a plurality of arms, a plurality of stretchers, a plurality of ribs, a runner, and a motor. Each of the plurality of stretchers is coupled to the hub at one of a plurality of first joints. Each of the plurality of stretchers is coupled to one of the plurality of arms. Each of the plurality of ribs extends outwardly from one of the plurality of arms. Each of the plurality of the arms is more rigid than each of the plurality of ribs. The runner is moveable from a first position to a second position. Each of the stretchers is coupled to the runner at one of the plurality of second joints. The motor is coupled to the runner. The motor is adapted to move the runner from the first position to the second position.

In another embodiment, a handheld umbrella is provided including a hub, a plurality of arms, a plurality of stretchers, a plurality of ribs, a runner, a motor, and a shaft. Each of the plurality of arms is coupled to the hub. Each of the plurality of stretchers is coupled to one of the plurality of arms. Each of the plurality of ribs extends outwardly from one of the plurality of arms. The runner is moveable from a first position to a second position. Each of the plurality of stretchers is coupled to the runner. The motor is coupled to the runner. The motor is adapted to move the runner from the first position to the second position. The shaft includes a handle portion. The motor is embedded within the shaft.

In yet another embodiment, a method of manufacturing an umbrella is provided including coupling a plurality of arms to a hub, coupling each of a plurality of stretchers to one of the plurality of arms, coupling each of the plurality of ribs to one of the plurality of arms, coupling the plurality of stretchers to a runner, and coupling the runner to a motor. Each of the plurality of ribs extends outwardly from one of the plurality of arms. The runner is moveable from a first position to a second position such that lowering the runner to the first position opens the umbrella and raising the runner to the second position closes the umbrella. The motor is adapted to move the runner from the first position to the second position.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

In one example, an umbrella is provided including a hub, a plurality of arms, a plurality of stretchers, a plurality of ribs, a runner, and a motor. Each of the plurality of stretchers is coupled to the hub at one of a plurality of first joints. Each of the plurality of stretchers is coupled to one of the plurality of arms. Each of the plurality of ribs extends outwardly from one of the plurality of arms. Each of the plurality of the arms is more rigid than each of the plurality of ribs. The runner is moveable from a first position to a second position. Each of the stretchers is coupled to the runner at one of the plurality of second joints. The motor is coupled to the runner. The motor is adapted to move the runner from the first position to the second position.

One technical advantage of the systems and methods described below may be that the umbrella described herein may be convenient to operate due to the motorized fully automated opening and closing of the umbrella. For example, the umbrella may be opened and closed with just one hand of the user. Another technical advantage of the systems and methods described below may be that the umbrella described herein may be easily connected to and operated with a phone. Yet another technical advantage of the systems and methods described below may be that the umbrella described herein may be manufactured cost-effectively, using only a single tool and a single process, particularly for the folding mechanism.

Figure 1:
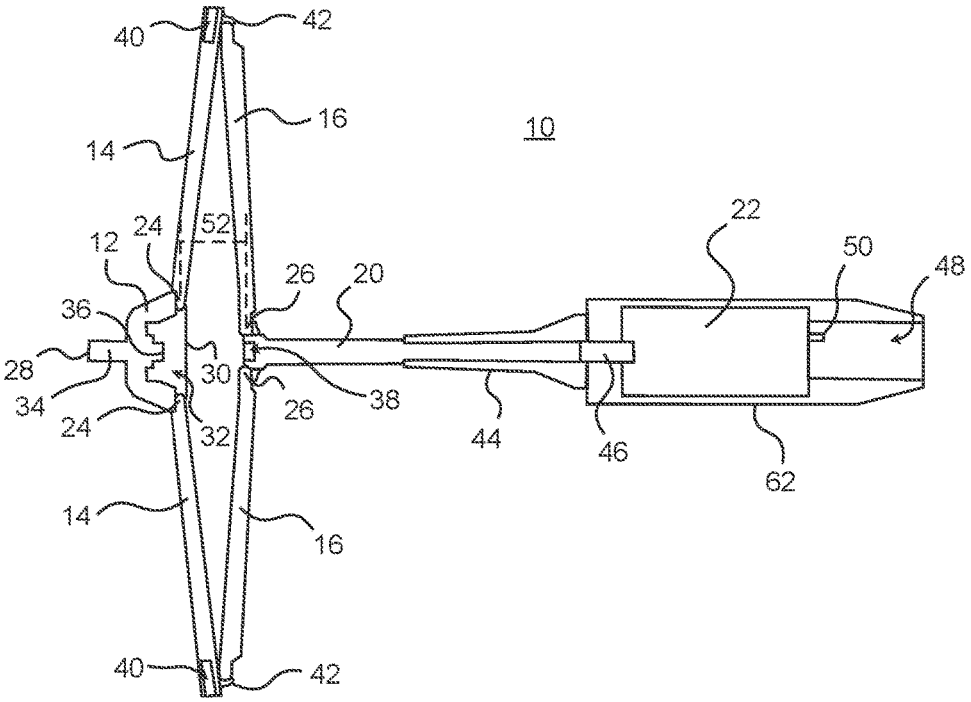
FIG. 1 illustrates a cross-sectional side view of a first example of a folding mechanism for an umbrella including a hub, arms, stretchers, a runner, and a motor.

FIG. 1 illustrates a cross sectional side view of a folding mechanism 10 for an umbrella (11 in FIG. 6) including a hub 12, a plurality of arms 14, a plurality of stretchers 16, a runner 20, and a motor 22. The umbrella 11 may be any device which is capable of shielding a user from rain or wind. The folding mechanism 10 may be any component of the umbrella 11 which is capable of expanding a canopy (72 in FIG. 6) to open the umbrella 11 or contracting the canopy 72 to close the umbrella 11. The umbrella 11 may be large enough to cover the user from rain, but small enough to be easily held by the user. The umbrella 11 may have a length of between 40 to 90 centimeters. The umbrella 11 may weigh less than 3 kilograms.

Figure 6:
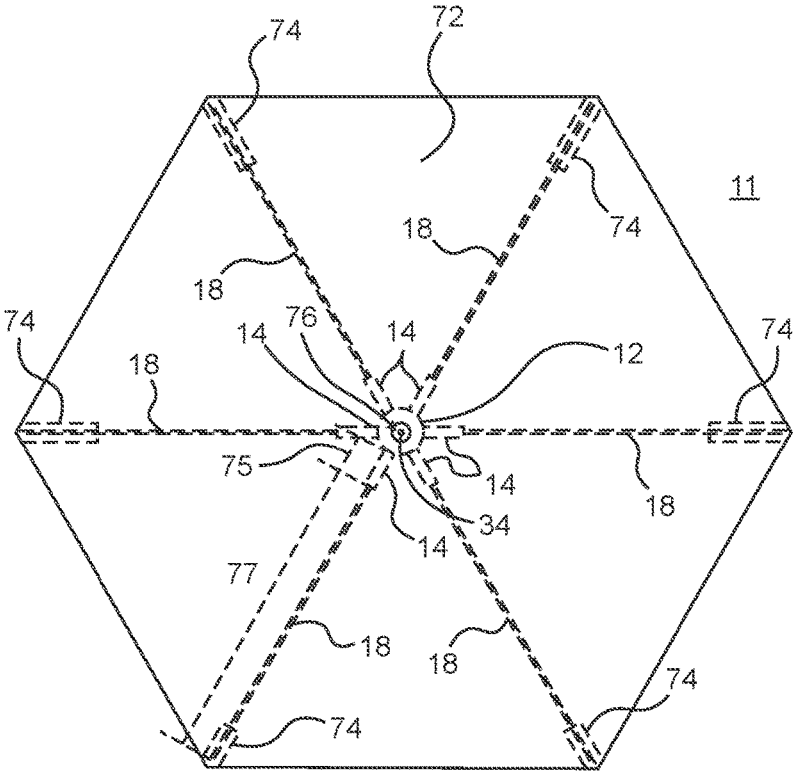
FIG. 6 illustrates a cross-sectional top view of a first example of an umbrella including a hub, arms, ribs, and a canopy.

The hub 12 may be any portion of the umbrella 11 which forms the center of the canopy (72 in FIG. 6). The hub 12 may extend from a top 28 to a bottom 30. The bottom 30 of the hub 12 may define a hub cavity 32 including a lower projection 36 situated within the hub cavity 32. The top 28 of the hub 12 may include an upper projection 34.

The plurality of arms 14 may be rotatably coupled to the hub 12 at a plurality of first joints 24. Each of the first joints 24 may be located at an interior end of the arm 14. The arms 14 may be any component of the umbrella 11 which extend from the hub 12 to at least partially define the shape of the umbrella 11. Examples of the arms may include poles, rods, or limbs. The first joints 24 between the arms 14 and the hub 12 may allow the arms to rotate between an open first position and a closed second position. Each of the arms 14 may also include an end cavity 40 adapted to receive a rib (18 in FIG. 6). Each end cavity 40 may be positioned on an exterior end of the arm 14 opposite from the first joint 24. Examples of the end cavity 40 may include a hole within the arm 14, a slot, or a crevice. Each of the arms 14 may include a receptable 42 adapted to receive a stretcher 16. The receptable 42 may be any component of the arm located toward the exterior end of the arm 14 which allows the stretcher 16 and the arm 14 to rotate relative to one another. Examples of the receptacle 42 may include a cavity, a pair of gripping tongs, or a snap joint.

Figure 2:
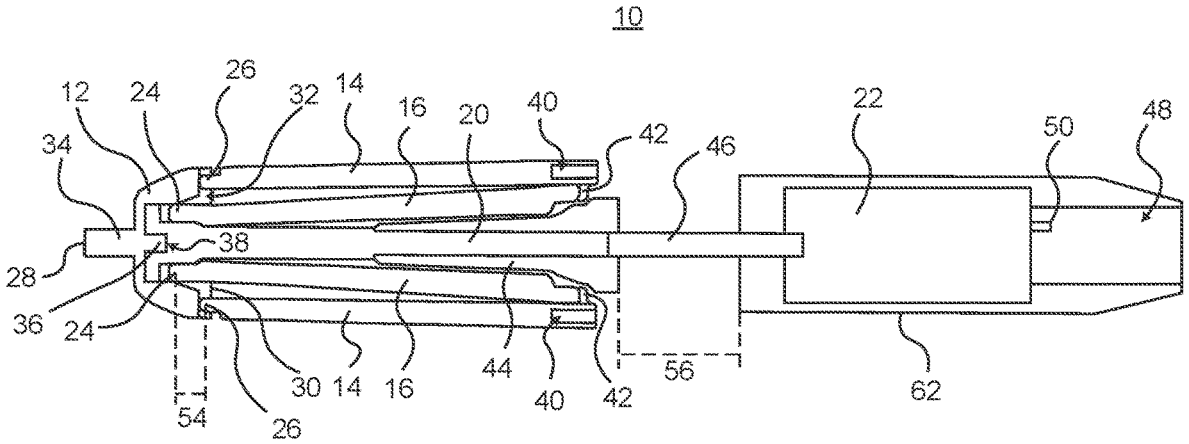
FIG. 2 illustrates another cross-sectional side view of the first example of a folding mechanism for an umbrella including the hub, the arms, the stretchers, the runner, and the motor.

The plurality of stretchers 16 may be rotatably coupled to each of the arms 14 at the receptables 42 of the arms 14 at exterior ends of the stretchers 16. The stretchers 16 may be any component of the umbrella 11 which is coupled to one the arms 14 and which provides support for one of the arms 14 while the umbrella 11 is in the first open position (as shown in FIG. 1). Examples of the stretchers 16 may include poles, rods, or boughs. The stretchers 16 may be made of any material capable of supporting the arms 14, including metals such as aluminum or plastics such as acrylonitrile butadiene styrene (ABS plastic). In some embodiments, the stretchers 16 may be longer than the arms 14 to allow the arms 14 and stretchers 16 properly fold when the umbrella 11 is in the second closed position (as shown in FIG. 2).

The runner 20 may be rotatably coupled to each of the plurality of stretchers 16 at a plurality of second joints 26. Each of the plurality of second joints 26 is arranged at an interior end of the stretcher 16. The runner 20 may be any component of the umbrella 11 which is moveable along a single axis to allow the umbrella 11 to reversibly move from the first open position to the second closed position. Examples of the runner 20 may include a piston, a cylinder, or a pole. The runner 20 may include a shaped sleeve 44 situated on the outer surface of the runner 20.

In some embodiments, the runner 20 may have an upper portion which is separable from a lower portion of the runner 20. The stretchers 16 may be arranged between the upper portion and the lower portion to form second joints 26. Screws may be used to secure the upper portion to the lower portion of the runner 20.

The runner 20 may be coupled to a motor 22 to reversibly move the runner 20 from a first position to a second position. When the runner 20 is in the first position (as in FIG. 1), the umbrella 11 may be in the first open position and when the runner 20 is in the second position (as in FIG. 2), the umbrella may be in the second closed position. The motor 22 may be any electrically operated device capable of moving the runner 20. In some embodiments, the motor 22 may move the runner 20 through turning of a threaded spindle 46 which is coupled to the runner 20. The motor 22 may be sufficiently powerful to advance or retract the runner 20 between the first position and the second position in no more than 5 seconds, but preferably in no more than 3 seconds.

The motor 22 may be encased within the shaft 62. The shaft 62 may be any portion of the umbrella 11 which is elongated and allows the user to maintain a position of the umbrella 11 while it is in the open position. Examples of the shaft 62 may include an elongated cylinder, a tube, or a pole. The shaft 62 may be made of any material sufficient for maintaining the position of the umbrella 11 while in the open position, such as aluminum, plastic, or carbon fiber.

Figure 7:
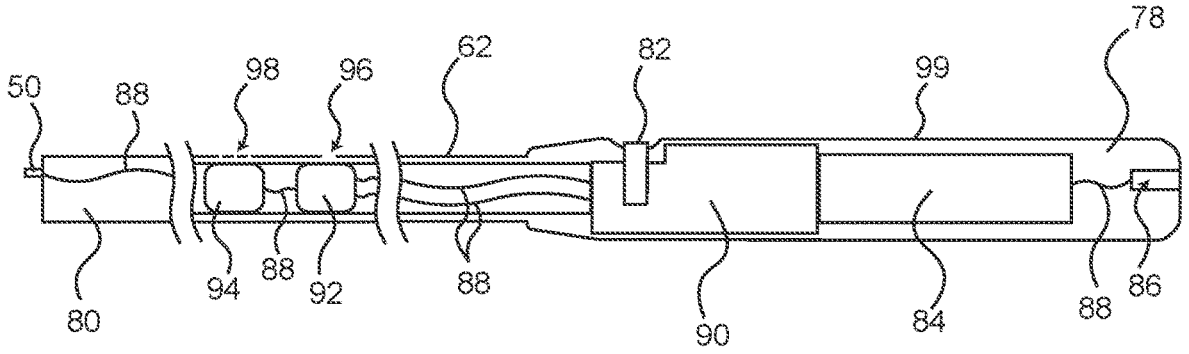
FIG. 7 illustrates a cross-sectional side view of a first example of a shaft including a control system, an electrical energy source, and a handle.

In some embodiments, the shaft 62 may divided into an upper portion (as shown in FIGS. 1 and 2) and a lower portion (as shown in FIG. 7). In such embodiments, the upper portion of the shaft 62 may be a component of the folding mechanism 10 which allows the folding mechanism 10 to separate from the other parts of the umbrella 11. Therefore, the upper portion of the shaft 62 may include an interior surface defining a port 48 to receive a shaft projection (80 in FIG. 7). Insertion of the shaft projection 80 into the port 48 may allow the upper portion and lower portion of the shaft 62 to be unified. In some embodiments, the upper portion of the shaft 62 may include the shaft projection 80 and the lower portion of the shaft 62 may include the port 48. An electrical connector 50 may be arranged within the port 48 to allow the motor to be powered by an electrical energy source (84 in FIG. 7) located in the lower portion of the shaft 62. A matching electrical connector 50 may be arranged on the shaft projection 80 of the lower portion of the shaft 62.

FIG. 1 illustrates the folding mechanism 10 in the open position, which corresponds to the umbrella 11 being in the first open position. In such a configuration, the arms 14 may extend outwardly from the hub 12 and the stretchers 16 may extend outwardly from the runner 20. Furthermore, the runner 20 may be in the first position, retracted on the spindle 46 such that the sleeve 44 may rest on a surface of the shaft 62.

While the folding mechanism 10 is in the open position, the runner 20 may be positioned beneath the bottom 30 of the hub 12. While the runner 20 is in the first position, the first joints 24 between the hub 12 and the arms 14 may be arranged to be closer to the top 28 of the hub 12 than the second joints 26 between the runner 20 and the stretchers 16. While the runner 20 is in the first position, the open distance 52 of the first joints 24 from the second joints 26 relative to the top 28 of the hub 12 may be between 1.50 and 4.60 centimeters, but preferably about 2.39 centimeters.

As illustrated in FIG. 1, an interior hub projection 36 may be arranged within the hub cavity 32. The interior hub projection 36 may be sized to fit into a seat 38 defined by the surface of the runner 20. In some embodiments, the seat 38 may be arranged within the hub cavity 32 and the projection 36 may be arranged on the runner 20. While the runner 20 is in the first position, the interior hub projection 36 and the seat 38 may be spaced apart.

FIG. 2 illustrates the folding mechanism of FIG. 1 in the closed position, which corresponds to the umbrella 11 being in the second closed position. In such a configuration, the arms 14 may project downward from the hub 12 and may rest closely to or against the stretchers 16. Furthermore, the stretchers 16 may project downwardly from the runner 20 and may rest closely to or against the runner 20 and the sleeve 44.

While the folding mechanism is in the closed position, the runner 20 may be in the second position, advanced along the spindle 46 by the motor 22 an advancement distance 56 of between 2 and 6 centimeters, but preferably about 3.09 centimeters. In some embodiments, the sleeve 44 may also be advanced along the spindle 46. In the second position, runner 20 may be at least partially advanced into the hub cavity 32 such that the interior hub projection 36 may be inserted into the seat 38 of the runner 20. The outer surface of the sleeve 44 may be shaped to closely receive the stretchers 16 while the folding mechanism 10 is in the closed position, constraining the motion of the arms 14 and stretchers 16 while the umbrella 11 is closed.

While the folding mechanism 10 is in the closed position, the second joints 26 may be arranged within the hub cavity 32. Therefore, in such a configuration, the second joints 26 may be arranged to be at least as close to the top 28 of the hub 12 than the first joints 24. In some embodiments, the second joints 26 may be arranged to be closer to the top 28 of the hub 12 than the first joints 24. While the runner 20 is in the second position, the closed distance 54 of the first joints 24 from the second joints 26 relative to the top 28 of the hub 12 may be between 0.50 and 1.40 centimeters, but preferably about 0.70 centimeters. In some embodiments, the sum of the open distance 52 and the closed distance 54 may be equal to the advancement distance 56 of the runner 20 from the first position to the second position.

As illustrated in FIGS. 1 and 2, lowering the runner 20 relative to the top 28 of the hub 12 from the second position to the first position may cause the umbrella 11 to open. Similarly, raising the runner 20 relative to the top 28 of the hub 12 from the first position to the second position may cause the umbrella 11 to close.

Figure 3:
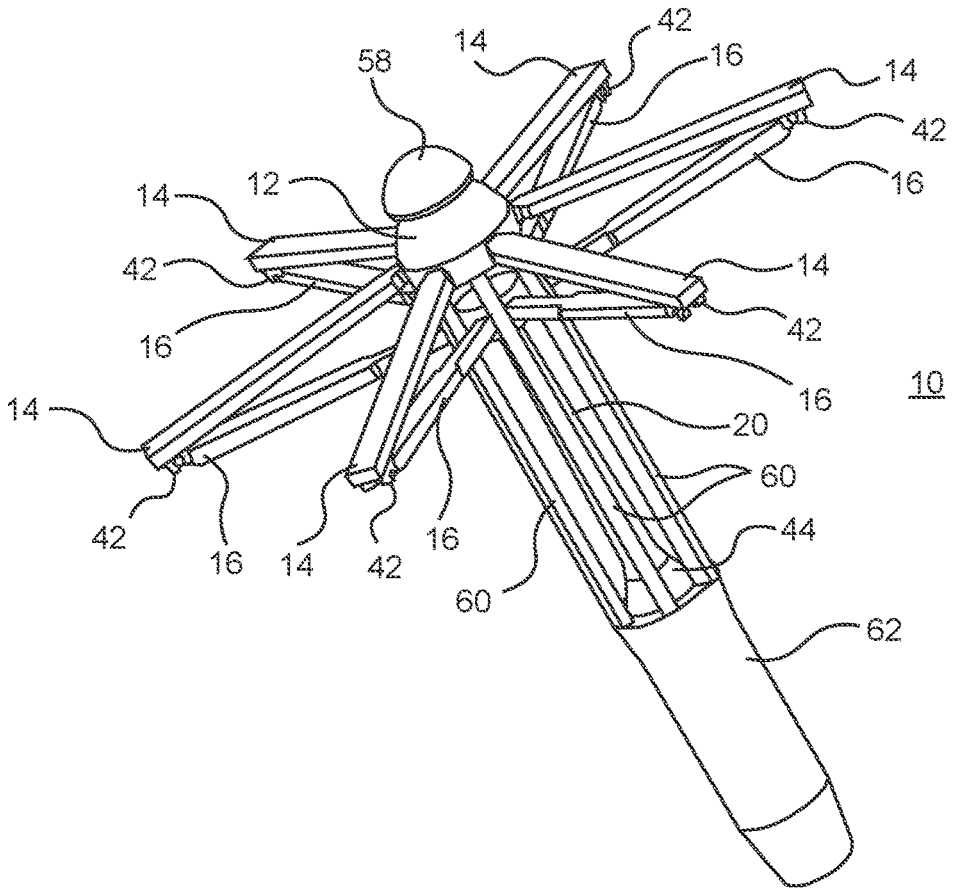
FIG. 3 illustrates a perspective view of a second example of a folding mechanism for an umbrella including a hub, arms, stretchers, a runner, and a motor.

FIG. 3 illustrates a perspective view of an embodiment of the folding mechanism 10. In some embodiments, the shaft may be extended to be coupled to the hub 12 through one or more struts 60. The struts 60 may be any component which forms a direct coupling between the shaft 62 and the hub 12. In some embodiments, the struts 60 may be integral to the shaft 62. An example of the struts 60 may be an extension of the shaft 62 which extends through an interior of the runner 20 to be coupled to the hub 12.

As illustrated in FIG. 3, another possible example of the struts 60 may include a plurality of struts 60 spaced around the runner 20. In such a configuration, the struts 60 may be spaced apart from each other to form gaps. When the umbrella 11 is closed, the stretchers 16 and arms 14 may move to fill these gaps between the struts 60.

The umbrella 11 may also include a hub cap 58 which may be inserted onto the upper projection 34 of the hub 12. To accommodate and secure the hub cap 58, the upper projection 34 may be threaded such that the hub cap 58 may be screwed onto the upper projection 34.

Figure 4:
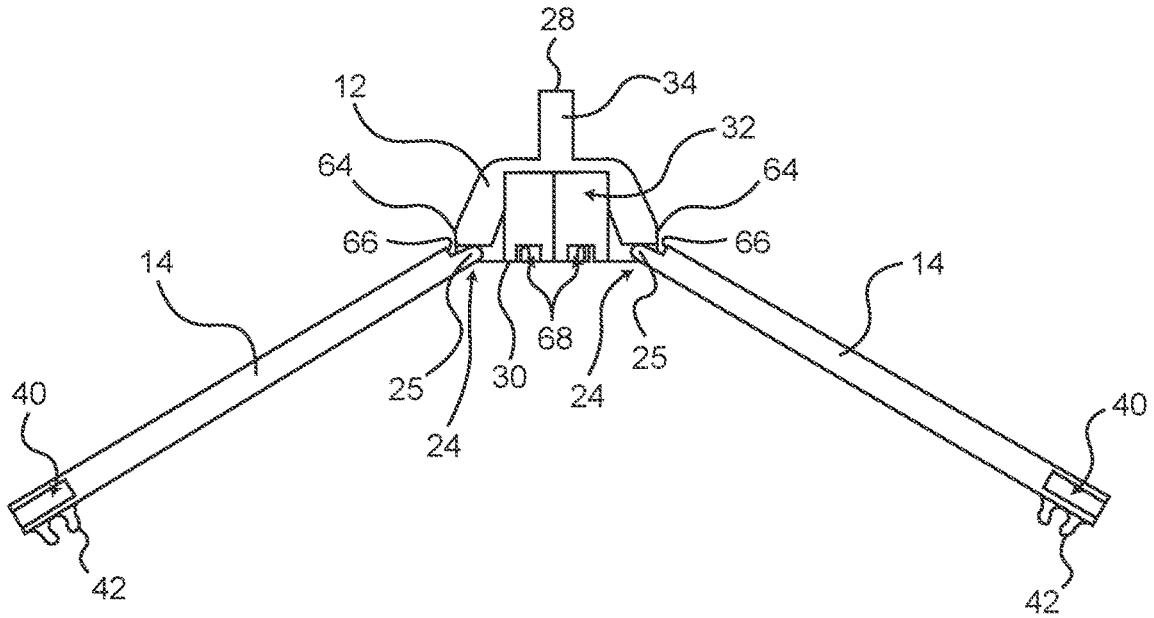
FIG. 4 illustrates a cross-sectional side view of a third example of a hub and arms.

FIG. 4 illustrates a cross-sectional side view of the hub 12 and two arms 14. The bottom 30 of the hub 12 may define one or more joint slots 68 to receive an equivalent number of arms 14. The joint slots 68 may be in connection with the hub cavity 32 or may be separated. A shoulder 25 may extend from the interior end of each of the arms 14. The shoulders 25 may be adapted to be positioned within the joint slots 68 to form the first joints 24.

The hub 12 may include an outer surface 64 which is shaped to limit the rotation of the arms 14 within the first joints 24. For example, as illustrated in FIG. 4, each arm 14 may include a notch 66 which is shaped to rest against the outer surface 64 of the hub 12 when the limit of the rotation of the arm 14 within the first joint 24 has been reached. This restriction on the rotation of the arms 14 may prevent the umbrella 11 from inverting when the umbrella is in a high wind environment.

In some embodiments, the struts 60, as illustrated in FIG. 3, may be utilized to secure the shoulders 25 of the arms 14 within the joint slots 68. For example, the bottom 30 of the hub 12 may be open, allowing the shoulder 25 to be placed within the joint slot 68. The struts 60 may be placed over the bottom 30 of the hub 12, securing the shoulder 25 between in the joint slot 68 between the hub 12 and the strut 60. The struts 60 may be secured to the hub 12 by a plurality of screws inserted from an upper surface of the hub 12 and extending downward into the strut 60.

Figure 5:
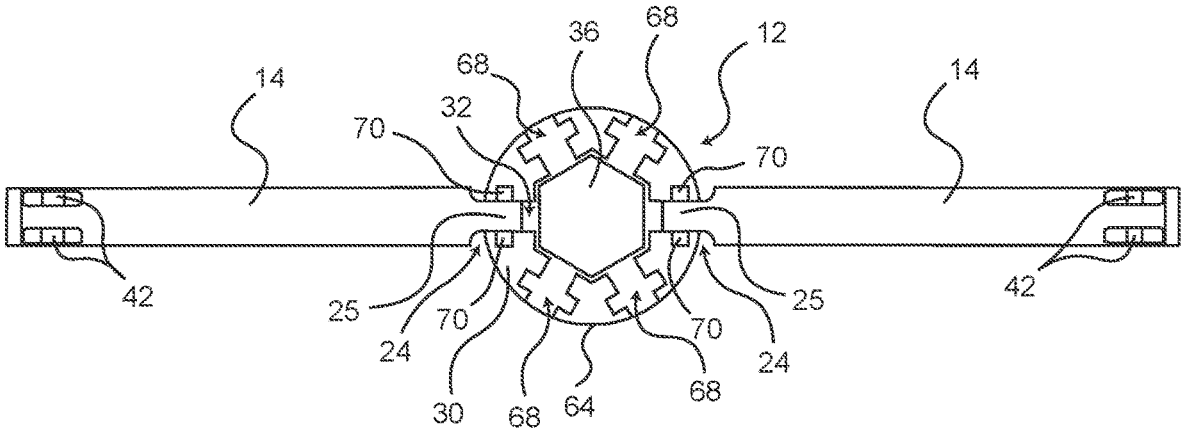
FIG. 5 illustrates a plan bottom view of a fourth example of a hub and arms.

FIG. 5 illustrates bottom view of the hub 12 and two arms 14. The joint slots 68 of the hub 12 may have a cross or T-shape. Accordingly, each arm 14 may include one or more lobes 70 which may be arranged within the joint slots 68. The complex shape of the arms 14 within the joint slots 68 may prevent rattling or vibration of the arm 14 relative to the hub 12 and restrict movement of the arm orthogonal to an axis of rotation of the first joint 24. The tightly constrained first joints 24 between the arms 14 and the hub 12 may enhance the stability of the umbrella 11 as a whole, since the first joints 24 are likely to be where the umbrella is under the greatest mechanical stress. Alternatively, in an embodiment without struts 60, the shoulders 25 may be secured between the hub 12 and a cylindrical spacer (not shown) extending about the bottom 30 of the hub 12.

FIG. 6 illustrates a top view of an example of the umbrella 11 including the canopy 72, the hub 12, arms 14, and a plurality of ribs 18. The canopy 72 may be any component of the umbrella 11 which extends over the hub 12, arms 14, and ribs 18 to form a protective cover for the user of the umbrella 11. In some embodiments, the canopy 72 may include an opening 76 at its center. The opening 76 may be large enough to receive the upper projection 34 of the hub 12 and may be smaller than the upper surface of the hub 12. The hub cap 58 may be sized to be larger than the opening 76 of the canopy 72 such that once the canopy 72 has been placed over the upper projection 34, the hub cap 58 may be secured to the upper projection 34 to secure the canopy 72 between the upper surface of the hub 12 and the hub cap 58. In such a configuration, the canopy 72 may be easily changed if damaged or customized to a user's preference.

The canopy 72 may further include a plurality of canopy sleeves 74, wherein each canopy sleeve 74 may be configured to receive an exterior end of a rib 18. The canopy sleeves 74 may be sown into the under side of the canopy 72 such that they may not be visible from the top of the canopy 72. Furthermore, the canopy sleeves 74 may be sized between 2 and 20 centimeters in length to sufficiently secure the ribs 18 within the canopy sleeves 74, but also allow the ribs 18 from the canopy sleeves 74 to be manually removed by a user replacing the canopy.

The ribs 18 may be any component of the umbrella 11 which extends outwardly from one of the arms 14. Examples of the ribs 18 may include a pole, a rod, or a wire. The ribs 18 may include an interior end arranged within the end cavity 40 of the arms 14 and an exterior end extended outwardly and opposite from interior end. Each of the ribs 18 may be friction-fitted into one of the end cavities 40 such that the ribs are held in place between the end cavities 40 and the canopy sleeves 74. The ribs 18 may be made of a strong but flexible material such as aluminum, steel alloys, wood, bamboo, or carbon fiber. The ribs 18 may be somewhat flexible to allow some movement in the canopy 72. This flexibility makes the canopy 72 easer to be manually removed by the user and makes the umbrella 11 easier to hold by the user during high winds. Each of the arms 14 may be more rigid than each of the ribs 18 to enhance the overall stability of the umbrella 11 and to prevent the umbrella 11 from inverting in high winds.

Allowing flexibility and maintaining stability of the umbrella 11 may also be governed by the relative lengths of the arms 14 as they extend outwardly from the hub 12 and of the ribs 18 as they extend outwardly from the arms 14. For example, if the ribs 18 are too long relative to the arms 14, the umbrella 11 may effectively be inverted in high winds even with the added stability of the arms 14. Alternatively, if the ribs 18 are too short relative to the arms 14, the umbrella 11 may be too rigid and inflexible to be easily held in high winds. Furthermore, in such a configuration, the canopy 72 may be too securely attached to the umbrella 11 such that it cannot be manually removed and replaced. For at least these reasons, the lengths 75 of the arms 14 should be between 10 and 20 centimeters. Additionally, the lengths 77 of the ribs 18 should be between 30 and 60 centimeters. Even if the umbrella 11 was scaled up or down from these lengths 75, 77, a ratio between the lengths 75 of the ribs 18 and the lengths of the arms 14 should be between 1.5 and 3.0, but preferably about 2.0.

FIG. 7 illustrates a cross-sectional side view of an example of the lower portion of the shaft 62 including the electrical energy source 84, an electrical port 86, a control system 90, a microphone 92, and a speaker 94. The lower portion of the shaft 62 may include a handle portion 78 including a grippable outer surface 99 by which the user may securely hold the umbrella 11. For example, the grippable outer surface 99 may include a surface treatment such as dimples or roughening to allow the user to better secure the handle portion 78.

The electrical energy source 84 may be any component of the umbrella 11 which provides electrical energy to operate the motor 22 and any other electrically operated devices within the umbrella 11. Examples of the electrical energy source 84 may include a battery or a connection to an alternating current (AC) power source. In some embodiments, the electrical energy source 84 is capable of providing electrical power at a voltage of between 3.0 and 3.7 Volts to allow for a smaller and lighter electrical energy source 84[Soi]. The electrical energy source 84 may be charged through an electrical port 86 defined on the outer surface of the shaft 62. Examples of the electrical port 86 may include a universal serial bus (USB) port, a 2-pole outlet plug, or a direct current (DC) power cable.

A control system 90 may also be embedded within the shaft 62. The control system 90 may be any component which may operate any electrically operated devices in the umbrella 11. For example, the control system 90 may be in electrical communication with the motor 22 and the electrical energy source to selectively operate the motor 22 according to a user input. The control system 90 may include a switch 82 which is accessible from the outer surface of the shaft 62 manipulate the control system 90 to operate the motor 22. Examples of the switch 82 may include a button, a slider, or a toggle switch.

In some embodiments, the control system 90 may include a transmitter/receiver, such as a Bluetooth® short-range wireless device. Such a transmitter receiver may allow the control system 90 to integrate with and be operated by an external device, such as a phone. Furthermore, such embodiments of the umbrella 11 may include the microphone 92 and the speaker 94 embedded within the shaft 62. A microphone opening 96 and also one or more speaker openings 98 may be defined on the outer surface of the shaft 62 to allow audio communication between a user and the speaker 94 and microphone 92.

A user may connect their phone to the control system 90 of the umbrella 11 to use the microphone 92 and speaker 94 as an alternative phone audio system. As a result, the user may not need to use a hand to operate the phone, allowing them to maintain control of the umbrella 11 with at least one hand.

In some embodiments all electrical components of the umbrella 11 may be manipulated by a single switch 82 accessible from the outer surface. For example, a quick press of the switch 82 may open the umbrella 11 and a second quick press of the switch 82 may close the umbrella 11. Furthermore, the phone may be at least partially controlled by the single switch 82. For example, a long press of over 3 seconds may connect and disconnect the phone from the control system 90. While a phone is connected, two quick presses of the switch 82 may answer an incoming call or end a call. Furthermore, tilting the switch 82 upward or downward may raise or lower the volume of the speaker 94.

In another embodiment, a power toggle (not shown) may be included on the outer surface of the shaft to electrically connect the electrical energy source 84 to the other electrically operated components of the umbrella 11. In such an embodiment, when the power toggle is in the "on" position, all electrical components of the umbrella 11 may be manipulated by the single switch 82. When the power toggle is in the "off" position, the electrical components of the umbrella 11 may be inoperative. In such an embodiment, the power toggle may not operate any electrically operated components of the umbrella 11, but merely allows the single switch 82 to operate the electrically operated components. In some embodiments, the power toggle may be incorporated into the single switch 82. For example, the single switch 82 may slide from a first unpowered, inoperable position into a second position. In the second position, the electrically operated components of the umbrella 11 may be powered and operable by the single switch 82.

Furthermore, although specific components are described above, methods, systems, and articles of manufacture described herein may include additional, fewer, or different components. For example, additional electrical components could be incorporated into the umbrella 11 to be operated by the control system 90. In one embodiment a small fan could be incorporated into the shaft 62 or folding mechanism 10 to circulate air within the canopy 72 while the umbrella 11 is open.

Figure 8:
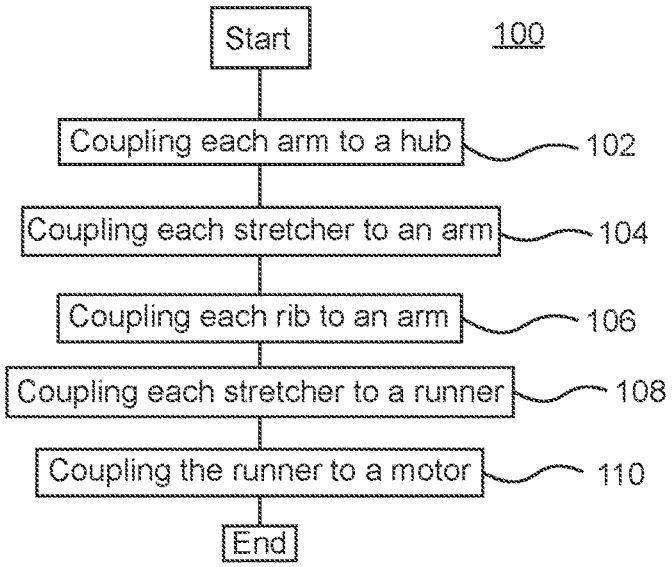
FIG. 8 illustrates a flow diagram of operations to manufacture an umbrella.

FIG. 8 illustrates a flow diagram of operations to manufacture an umbrella 11. The operations may include fewer, additional, or different operations than illustrated in FIG. 8. Alternatively or in addition, the operations may be performed in a different order than illustrated.

The umbrella 11 may be formed in a manufacturing process 100. The plurality of arms 14 may be coupled to the hub 12 (102). Each of the plurality of stretchers 16 may be coupled to one of the arms 14 (104). The plurality of stretchers 16 may also be coupled to the runner 20 (108). Each of a plurality of ribs 18 may be coupled to one of the arms 14 (106). The runner 20 may be coupled to the motor 22 (110). The runner 20 may be moveable from a first position to a second position such that lowering the runner 20 away from the hub 12 from the first position to the second position opens the umbrella 11. Conversely, raising the runner 20 toward the hub 12 from the second position to the first position closes the umbrella 11.

In some embodiments, some or all of the manufacturing process 100 described above may be performed using only a single tool or a single process. For example, as discussed above, the arms 12 may be coupled to the hub 12 (102) using screws extending between the hub 12 and the struts 60. The screws may be inserted into the hub 12 by use of a screwdriver. The stretchers 16 may be coupled to the arms 14 (104) by a receptacle 42 in the form of a snap joint, requiring only manual insertion by hand. Similarly, the ribs 18 may be manually inserted into the end cavities 40 of the arms 14 (106) and held in place by friction fitting. The stretchers 16 may be coupled to the runner 20 (108) by an upper portion of the runner 20 being screwed onto a lower portion of the runner 20 by hand or by use of a screwdriver. The runner 20 may be screwed onto the spindle 46 of the motor 22 (110) by hand or by use of a screwdriver. As a result of this method, the umbrella 11 may be manufactured using only a screwdriver or through manual hand operation, significantly simplifying and decreasing the cost of the manufacturing process In addition to the advantages that have been described, it is also possible that there are still other advantages that are not currently recognized but which may become apparent at a later time. While various embodiments have been described, it will be apparent to those of ordinary skill in the art that many more embodiments and implementations are possible. Accordingly, the embodiments described herein are examples, not the only possible embodiments and implementations.

What is claimed is:

1. An umbrella comprising:

a hub comprising a top and a bottom;

a plurality of arms, wherein each of the plurality of arms is coupled to the hub at one of a plurality of first joints;

a plurality of stretchers, wherein each of the plurality of stretchers is coupled to one of the plurality of arms;

a plurality of ribs, wherein each of the plurality of ribs extends outwardly from one of the plurality of arms and each of the plurality of arms is more rigid than each of the plurality of ribs;

a runner moveable from a first position to a second position, wherein each of the plurality of stretchers is coupled to the runner at one of a plurality of second joints, wherein the bottom of the hub defines a cavity adapted to receive the runner while the runner is in the second position; and a motor coupled to the runner, wherein the motor is adapted to move the runner from the first position to the second position.

2. The umbrella of claim 1, wherein the plurality of first joints each comprise a shoulder extending from one of the plurality of arms, wherein the shoulder is adapted to be positioned within a T-shaped joint slot defined by a bottom of the hub.

3. The umbrella of claim 2, wherein rotation of the arms within the first joints is restricted by a notch formed into the arm, wherein the notch is shaped to rest against an outer surface of the hub while the runner is at or near the first position.

4. The umbrella of claim 1, wherein the plurality of arms are made of plastic.

5. The umbrella of claim 4, wherein the plurality of ribs are made of carbon fiber.

6. The umbrella of claim 1, wherein:

while the runner is in the first position wherein the umbrella is open, each of the plurality of first joints are arranged to be closer to the top of the hub than the plurality of second joints; and while the runner is in the second position wherein the umbrella is closed, each of the plurality of second joints are arranged to be at least close to the top of the hub than the plurality of first joints.

7. The umbrella of claim 1, wherein the runner moves no more than 5 centimeters from the first position to the second position.

8. The umbrella of claim 7, wherein the motor is adapted to move from the first position to the second position in no more than 3 seconds.

9. The umbrella of claim 7, wherein a length of each of the ribs is at least 30 centimeters.

10. The umbrella of claim 1, further comprising a canopy extended across the plurality of arms and the plurality of ribs, wherein the canopy includes a plurality of sleeves and each of the plurality of sleeves is adapted to receive at least one of the plurality of ribs.

11. A handheld umbrella comprising:

a hub comprising a top and a bottom;

a plurality of arms, wherein each of the plurality of arms is coupled to the hub;

a plurality of stretchers, wherein each of the plurality of stretchers is coupled to one of the plurality of arms;

a plurality of ribs, wherein each of the plurality of ribs extends outwardly from one of the plurality of arms;

a runner moveable from a first position to a second position, wherein each of the plurality of stretchers is coupled to the runner and the bottom of the hub defines a cavity adapted to receive the runner while the runner is in the second position;

a motor coupled to the runner, wherein the motor is adapted to move the runner from the first position to the second position; and a shaft comprising a handle portion, wherein the motor is embedded within the shaft.

12. The handheld umbrella of claim 11, wherein the shaft is coupled to the hub.

13. The handheld umbrella of claim 11, further comprising an electrical energy source adapted to operate the motor, wherein the electrical energy source is embedded within the shaft.

14. The handheld umbrella of claim 13, wherein the electrical energy source has a voltage no greater than 3.7 Volts.

15. The handheld umbrella of claim 13, further comprising a USB port arranged on an outer surface, wherein the USB port is electrically coupled to the electrical energy source.

16. The handheld umbrella of claim 11, further comprising a microphone and a speaker embedded within the shaft.

17. The handheld umbrella of claim 11, further comprising a control system adapted to operate the motor, and a switch arranged on an outer surface of the shaft and adapted to manipulate the control system.

18. The handheld umbrella of claim 17, wherein no more than a single switch is accessible from the outer surface of the shaft to operate the motor.

19. A method of manufacturing an umbrella comprising:

coupling a plurality of arms to a hub comprising a top and a bottom;

coupling each of a plurality of stretchers to one of the plurality of arms;

coupling each of a plurality of ribs to one of the plurality of arms, wherein each of the plurality of ribs extends outwardly from one of the plurality of arms;

coupling the plurality of stretchers to a runner, wherein the runner is moveable from a first position to a second position such that lowering the runner to the first position opens the umbrella and raising the runner to the second position closes the umbrella and the bottom of the hub defines a cavity adapted to receive the runner while the runner is in the second position; and coupling the runner to a motor adapted to move the runner from the first position to the second position.

20. The method of claim 19, wherein coupling the plurality of arms to the hub, coupling each of the plurality of stretchers to one of the plurality of arms, coupling each of the plurality of ribs to one of the plurality of arms, and coupling the plurality of stretchers to the runner are accomplished utilizing no other tools than a screwdriver.

* * * * *